US006118353A

United States Patent [19]

McKay

[11] Patent Number: 6,118,353

[45] Date of Patent: Sep. 12, 2000

[54] MICROWAVE POWER DIVIDER/COMBINER HAVING COMPACT STRUCTURE AND FLAT COUPLING

[75] Inventor: James P. McKay, Manhattan Beach, Calif.

[73] Assignee: Hughes Electronics Corporation, El Segundo, Calif.

[21] Appl. No.: 09/250,853

[22] Filed: Feb. 17, 1999

[51] Int. Cl.[7] ..... H01P 5/12

[52] U.S. Cl. ..... 333/125; 333/127; 333/128

[58] Field of Search ..... 333/117, 123, 333/125, 127, 136, 137, 128, 109, 114, 115, 116

*Primary Examiner*—Robert Pascal
*Assistant Examiner*—Kimberly E Glenn
*Attorney, Agent, or Firm*—T. Gudmestad; M. W. Sales

[57] ABSTRACT

A power divider/combiner for dividing received powers at 4 input ports, transmitting the divided powers to each of 4 output ports and combining the transmitted powers at each of the output ports. The power divider combiner has through transmission lines flanked on either side by secondary through transmission lines that interconnect corresponding input and output ports. The through transmission lines are likewise interconnected at a center node by a plurality of branch transmission lines. A method for making a power divider/combiner includes merging two 0 dB couplers by joining the center points of each of the branch transmission lines.

16 Claims, 6 Drawing Sheets

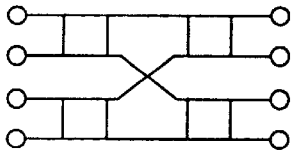
(PRIOR ART)
FIG. 5
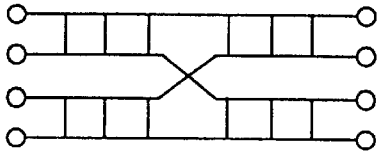
(PRIOR ART)
FIG. 6
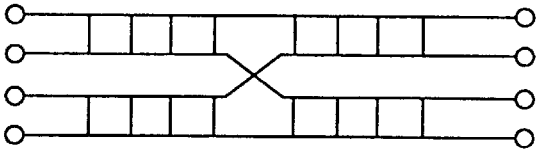
(PRIOR ART)
FIG. 7
| Power Divider/Combiner | Return Loss (dB) | Isolation (dB) | Coupling Unbalance (dB) | Relative Size (wavelengths) |
|---|---|---|---|---|
| Compact 4 x 4 Hybrid | -57 | 61 | 0.068 | 3.25 |
| 4 x 4 Matrix of 2-Branch 2 x 2 Hybrids | -34 | 28 | 0.046 | 4.0 |
| 4 x 4 Matrix of Maximally-Flat 3-Branch 2 x 2 Hybrids | -56 | 51 | 0.009 | 7.0 |
| 4 x 4 Matrix of Maximally-Flat 4-Branch 2 x 2 Hybrids | -56 | 50 | 0.008 | 10.0 |
| Compact 4 x 4 Hybrid Having Flat Coupling | -45 | 100 | 0.0005 | 6.0 |
FIG. 8

MICROWAVE POWER DIVIDER/COMBINER HAVING COMPACT STRUCTURE AND FLAT COUPLING

TECHNICAL FIELD

The present invention relates to passive microwave devices and more particularly to microwave power divider/combiners.

BACKGROUND ART

Microwave devices are generally divided into the broad categories of passive and active devices. Included under the heading of passive microwave devices are microwave hybrids which are multiport networks that are specifically configured for signal routing between the network ports. A device port into which power is normally fed is typically referred to as an incident port or an input port. A port from which power is extracted is called a coupled port or an output port and other ports (from which power is not extracted) are called isolated ports.

Microwave hybrids generally divide the power at each of a plurality of input ports into equal portions, transmit each of the divided portions to a respective one of a plurality of output ports and combine the transmitted powers at each output port. Accordingly, microwave hybrids are often called power divider/combiners.

An example of a four-port (2×2) power divider/combiner has two input ports and two output ports. In a perfect divider/combiner, the incident power at each input port would be divided into two equal portions which are each transmitted to a respective one of the output ports (i.e., the power division is perfect). None of the incident power would be reflected from the input ports and none of the power at any one of the input ports would be transmitted to the other ports (i.e., the input ports are perfectly matched to their power sources and the isolation between ports is perfect).

Most conventional power divider/combiners successfully divide powers received at input ports and combine these divided powers at output ports, they typically include an excessive number of transmission lines members and in some instances have degraded electrical performance, meaning high return loss, poor isolation and high coupling unbalance. Their use in microwave circuits, therefore, has a negative effect upon the size, weight and performance of these circuits. The weight of a microwave circuit is emphasized when the hybrid's transmission line members are realized in waveguide or coaxial form and the effect is especially costly when such realizations are intended for weight sensitive applications such as spacecraft.

An example of such a spacecraft application is an antenna array having a beam forming network which includes twenty-two coaxial 8×8 hybrids (each hybrid is formed with twelve 2×2 hybrids). Power divider/combiners that can be realized with less transmission-line members and smaller size would provide significant cost savings. Also, achieving flat coupling of the output powers will significantly enhance electrical performance and in particular coupling unbalance.

SUMMARY OF THE INVENTION

The present invention is a microwave power divider/combiner that has $2^n$ input ports and $2^n$ output ports, where n is an integer >1, which has enhanced electrical performance and in many instances requires fewer transmission line members than most conventional power divider/combiners and a method for making the same. The present invention has a physical configuration that enhances electrical performance of the power divider/combiner over conventional power divider/combiners. The power divider/combiner of the present invention has a low return loss, high isolation, low coupling unbalance, and a relatively small size and weight.

The power divider/combiner of the present invention is an arrangement of transmission lines having predetermined normalized characteristic impedances and predetermined electrical lengths. The transmission lines are arranged in a physical configuration such that when the characteristic impedance of the transmission lines is selected for a desired bandwidth, very flat coupling is achieved, thereby enhancing electrical performance of the power divider/combiner over conventional power divider/combiners.

The power divider/combiner of the present invention is comprised of a series of through transmission lines each of which has a primary through transmission line flanked by secondary transmission lines. The points of intersection of the primary through transmission line and the secondary through transmission lines are referred to as nodes. The input and output ports are at the ends of the secondary transmission lines and are themselves interconnected at a central node through branch transmission lines. The nodes at the points of intersection of the primary through transmission line and the secondary transmission line are also interconnected at a central node.

Another embodiment of the 4×4 power divider/combiner of the present invention has through transmission lines of equal lengths and a predetermined number of branch lines. The branch lines also have equal lengths. The power divider/combiner is made by bringing together two identical 0 dB branch line couplers to form junctions at the central points of each branch line. This can be used to design many different 4×4 power divider/combiners having any number of branches. Additionally, the 0 dB couplers may be constructed by cascading two 3 dB couplers and combining the two innermost branch lines into one branch line.

It is an object of the present invention to reduce the relative size and weight of a power divider/combiner. It is another object of the present invention to improve the electrical performance of a power divider/combiner.

BRIEF DESCRIPTION OF THE DRAWINGS

FIG. 5 is a prior art 4×4 matrix of two-branch hybrids;

FIG. 6 is a prior art 4×4 matrix of maximally-flat three-branch 2×2 hybrids;

FIG. 7 is a prior art 4×4 matrix of maximally-flat four-branch 2×2 hybrids;

FIG. 8 is a table comparing the electrical performance of the power divider/combiner of the present invention with the electrical performance of the four different prior art power divider/combiners in FIGS. 4 through 7;

BEST MODES FOR CARRYING OUT THE INVENTION

The teachings of the present invention are generally directed to $2^n \times 2^n$ power divider/combiners wherein n is an integer >1. However, these teachings can be best understood if they are initially described with reference to specific power divider/combiner embodiments. Accordingly, attention is first directed to the 4×4 power divider/combiner 10 shown in schematic in FIG. 1. One of ordinary skill in the art is capable of combining the 4×4 power divider/combiner to achieve 8×8, 16×16, etc. power divider combiners.

Figure 1:
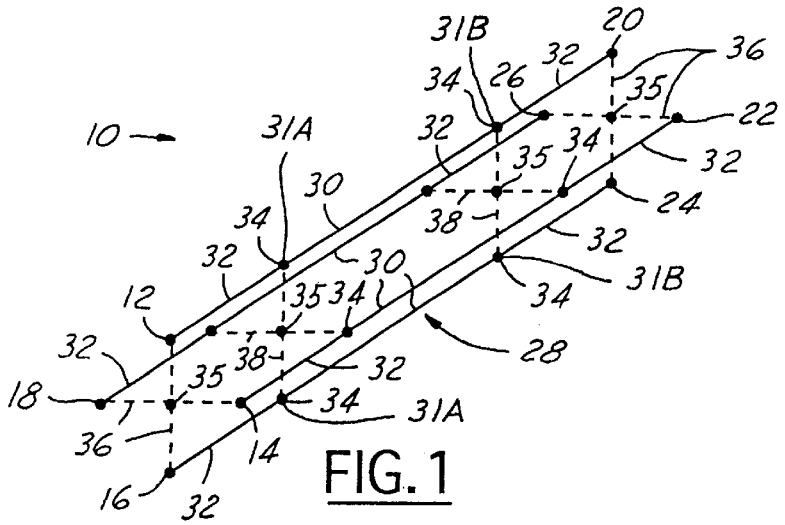
FIG. 1 is a schematic representation of the power divider/combiner of the present invention.
Figure 2A:
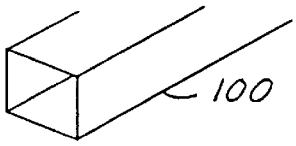
FIG. 2A is a cross section of a rectangular waveguide.
Figure 2B:
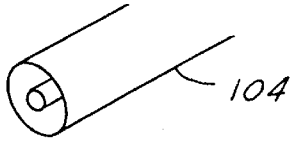
FIG. 2B is a cross section of a circular coaxial cable.
Figure 2C:
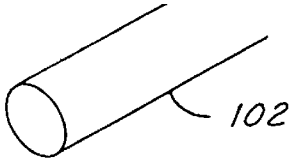
FIG. 2C is a cross section of a circular waveguide.
Figure 2D:
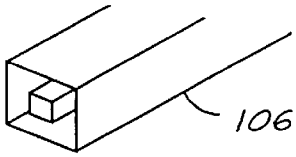
FIG. 2D is a cross section of a square coaxial cable.
Figure 2E:
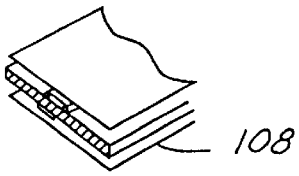
FIG. 2E is a cross section of a stripline.
Figure 2F:
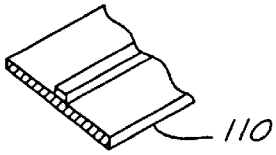
FIG. 2F is a cross section of a microstrip transmission line.
Figure 2G:
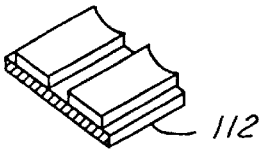
FIG. 2G is a cross section of a slot line.
Figure 2H:
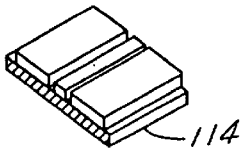
FIG. 2H is a cross section of a coplanar waveguide.

The power divider/combiner 10 is illustrated in FIG. 1 as a schematic. Various transmission lines can be used to configure the power divider/combiner of the present invention. Examples of different transmission lines are shown in FIGS. 2A through 2H. They include, but are not limited to, waveguides (e.g., rectangular waveguide 100 and circular waveguide 102), coaxial lines (e.g., circular coax 104 and square coax 106) and planar transmission lines (e.g., stripline 108, microstrip 110, slot line 112, and coplanar waveguide 114).

In general, power divider/combiners have transmission lines having electrical lengths, Θ, that are a quarter of a guide wavelength, $\lambda_g/4$, of signals at the center design frequency of the divider/combiner. Typically, the 4×4 power divider/combiner 10 would be coupled into a transmission line system that is configured with a characteristic impedance $Z_c$ that is external to the system. The characteristic impedance of the transmission lines is selected relative to the characteristic impedance $Z_c$, to achieve flat coupling over the desired bandwidth. In general, the optimum value for the characteristic impedance of the transmission line will depend upon the bandwidth and performance requirements for a particular application.

The power divider/combiner 10 of the present invention, shown in FIG. 1, is particularly suited for dividing received powers at each of four input ports 12, 14, 16, and 18, transmitting the divided powers of each input port to four output ports 20, 22, 24, and 26 and combining the transmitted powers at each of the output ports. The input and output ports are interconnected by a series of through transmission lines 28 having predetermined electrical lengths relative to the guide wavelength, $\lambda_g$ and predetermined characteristics impedances relative to the external characteristic impedance $Z_c$. $Z_c$ is usually 50 Ω in practice.

In the present example there are four series of transmission lines 28. Each of the four input ports is connected by one series of through transmission lines to a corresponding one of the four output ports.

In the preferred embodiment, the series of through transmission lines 28 that interconnect the input and output ports each have a primary through transmission line 30 having a length $\lambda_g/2$ that is flanked on either end by secondary through transmission lines 32, each having a length $\lambda_g/4$. The secondary through transmission lines 32 have a characteristic impedance equal to one half the characteristic impedance $Z_c$. The primary through transmission line 30 has a characteristic impedance equal to a variable multiple of the characteristic impedance, $Z_c$. The characteristic impedance of the primary through transmission line will vary depending on the desired frequency bandwidth. An optimum value can be determined through software modeling and trial and error in which the flattest possible output power curve is achieved.

The primary through transmission line 30 and the secondary through transmission lines 32 are connected together at nodes 34. There are two nodes 34 on each series of transmission lines 28. The nodes are points of intersection between each end of the primary transmission line 30 and the secondary transmission lines.

Central nodes 35 interconnect branch transmission lines 36 and secondary branch transmission lines 38 at each end of the divider/combiner 10. The four input ports 12, 14, 16, and 18 are interconnected at a central node 35 by four branch transmission lines 36 having a length that is an eighth the wavelength of the guide, $\lambda_g/8$. The characteristic impedance of the branch transmission lines 36 is equal to the external characteristic impedance $Z_c$. The four nodes 34 at the first end 31A of each of the primary through transmission lines 30 are interconnected at a central node 35 by four secondary branch transmission lines 38. The secondary branch transmission lines 38 have a length that is an eighth of the guide wavelength, $\lambda_g/8$ and a characteristic impedance that is one half of the external characteristic impedance $Z_c$.

The branch transmission lines 36 also interconnect the output ports 20, 22, 24, and 26 at a central node 35. Secondary branch transmission lines 38 also interconnect the nodes 34 at the second end 31B of each of the primary through transmission lines 30 at a central node 35.

The four primary through transmission lines 30 are end to end with the eight secondary through transmission lines 32 to define the four transmission line series 28. The combination of four primary through transmission lines 30, eight secondary transmission lines 32, eight branch transmission lines 36, eight secondary branch transmission lines 38, sixteen nodes 34, (which includes the input and output ports), and four central nodes 35 defines the structure of the 4×4 power divider/combiner 10 of the present invention.

The power divider/combiner 10 provides four simultaneous power divisions with zero return loss and perfect isolation at the center design frequency. It has minimal output power variation, low return loss and high isolation resulting in electrical performance that is improved over the prior art.

In general, the 4×4 power divider/combiner takes a signal incident upon any of the input ports 12, 14, 16, or 18 and couples the signal equally to the output ports 20, 22, 24 and 26. Therefore, the power at each output port is approximately 6.02 dB below the incident power. If only one input port 12 is driven, the signal phase at the nearest output port is +180 degrees relative to the signal phase at the other output ports. Because the device of the present invention has zero return loss, the reflected signal from the input port 12 is zero. The invention's operation can be summarized in a midband scattering matrix as follows:

$$[S] = -(1/2j)\begin{matrix} 0 & 0 & 0 & 0 & -1 & 1 & 1 & 1 \\ 0 & 0 & 0 & 0 & 1 & -1 & 1 & 1 \\ 0 & 0 & 0 & 0 & 1 & 1 & -1 & 1 \\ 0 & 0 & 0 & 0 & 1 & 1 & 1 & -1 \\ -1 & 1 & 1 & 1 & 0 & 0 & 0 & 0 \\ 1 & -1 & 1 & 1 & 0 & 0 & 0 & 0 \\ 1 & 1 & -1 & 1 & 0 & 0 & 0 & 0 \\ 1 & 1 & 1 & -1 & 0 & 0 & 0 & 0 \end{matrix}$$

The power is indicated by the square of each scattering matrix element. For example, the first column of the scattering matrix begins with $S_{11}=0$ which indicates no power is reflected from input port 12. The next three elements are $S_{21}$, $S_{31}$, and $S_{41}$ which indicates that no power is transmitted from the input port 12 to the input ports 14, 16, and 18.

The first column ends with $S_{51}=j\frac{1}{2}$, $S_{61}=-j\frac{1}{2}$, $S_{71}=-j\frac{1}{2}$, and $S_{81}=-j\frac{1}{2}$. The square of each of these matrix elements is $-\frac{1}{4}$, $-\frac{1}{4}$, $-\frac{1}{4}$ and $-\frac{1}{4}$ which indicates that the power at the input port 12 is equally divided among the output ports 20, 22, 24, and 26 and the signal phase at the output port 20 is 180 degrees out of phase compared to the signal phase at the other output ports. Finally, the scattering matrix is symmetric about a diagonal which indicates that the operation of the power divider/combiner 10 is not altered if the input and output ports are interchanged.

For example purposes a computer simulation of the present invention was performed in the bandwidth of 1525–1559 MHz, using ideal transmission lines. In the present example, the electrical lengths, Θ, of the primary through transmission lines are 180 degrees, the secondary through transmission lines are 90 degrees and each of the branch transmission and secondary branch transmission lines are 45 degrees at the center design frequency of 1542 MHz. The normalized characteristic impedances are as follows: the primary through transmission line impedance is 1.2057, the secondary through transmission line impedance is ½, the branch transmission line impedance is 1 and the secondary branch transmission line impedance is ½.

It should be noted that the primary transmission line impedance is a variable that changes with a change in the frequency bandwidth. The value 1.2057 is an optimum value for the specific bandwidth described above. The secondary transmission line impedance, the branch transmission line impedance and the secondary branch transmission line impedances are all unaffected by different bandwidths and remain unchanged.

In the example bandwidth, the power divider/combiner 10 of the present invention has the following approximate predicted electrical specifications:

Return Loss <−45 dB

Isolation >100 dB

Output Power Distribution: −6.02066±0.00007 dB

Output Phase Differential: 179.99995±0.00005 degrees

Figure 3:
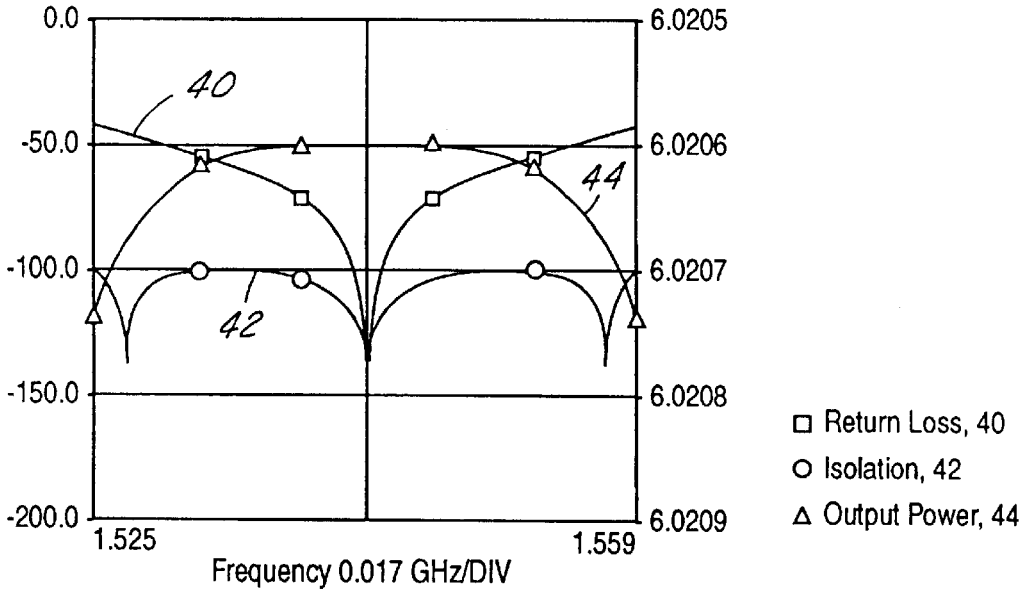
FIG. 3 is a graph of the electrical characteristics of the power divider/combiner of the present invention.

FIG. 3 shows the predicted frequency variation of the return loss, isolation, and output power. The return loss, denoted by 40, is the ratio of power reflected from a port to power incident upon that port. The isolation, denoted by 42, is the isolation between a driven input port and other input ports in the power divider/combiner 10.

The output power is denoted by 44 in FIG. 3. The output power curve 44 is a flat curve reflecting minimal changes in output power over a range of frequencies. In other words, flat coupling. The graph reflects the fact that power is divided equally over the four outputs over a wide frequency range showing the power divider/combiner 10 of the present invention as having a very small coupling unbalance. Coupling unbalance is the sum of the change in power at each of the four output ports. Mathematically coupling unbalance, U, can be described as:

$$U=|\Delta P_5|+|\Delta P_6|+|\Delta P_{7|+|\Delta P8|},$$

where $P_5$, $P_6$, $P_7$, and $P_8$ are the powers at the four output ports 20, 22, 24 and 26.

Figure 4:
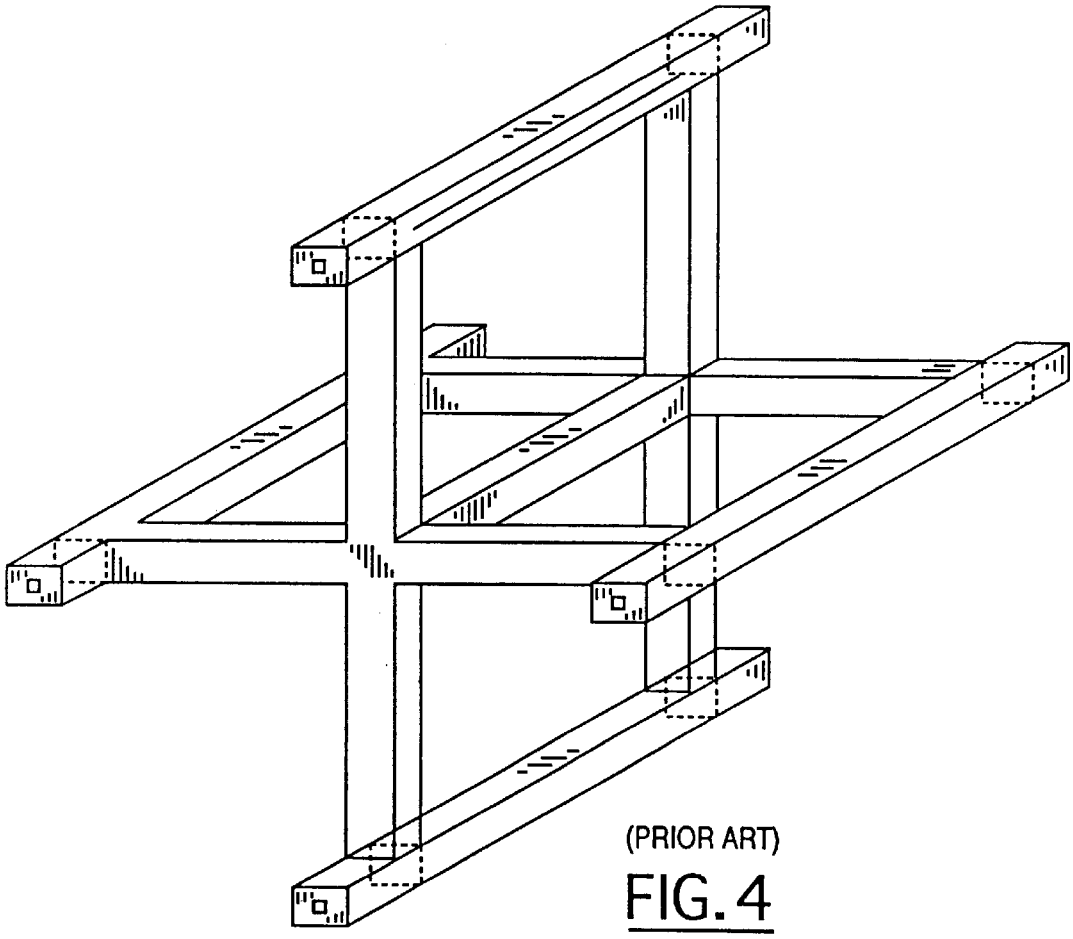
(PRIOR ART) FIG. 4
FIG. 4 is a prior art compact 4×4 hybrid.

The electrical performance of the power divider/combiner 10 of the present invention has been compared to other networks that perform the same function. The comparison includes a compact 4×4 hybrid as shown in FIG. 4 , a 4×4 matrix of two branch 2×2 hybrids as shown in FIG. 5, a 4×4 matrix of maximally-flat, synchronous three branch 2×2 hybrids as shown in FIG. 6, and a 4×4 matrix of maximally flat, synchronous 4 branch 2×2 hybrids as shown in FIG. 7.

FIG. 8 is a table outlining the return loss, isolation, coupling unbalance and relative size of the power divider/combiners. It is clear that the power divider/combiner 10 of the present invention can provide a smaller coupling unbalance than the other power divider/combiners thereby having a flat coupling. The power divider/combiner of the present invention is smaller in size than the three-branch and four-branch 4×4 power divider/combiners. But where accuracy and enhanced electrical performance are desired, and a sacrifice can be made in size and weight considerations, the power divider/combiner 10 of the present invention is an improvement over the compact 4×4 hybrid and 4×4 matrix of two branch 2×2 hybrids. The benefit to the larger size is the significantly enhanced electrical performance of the present invention.

Figure 9:
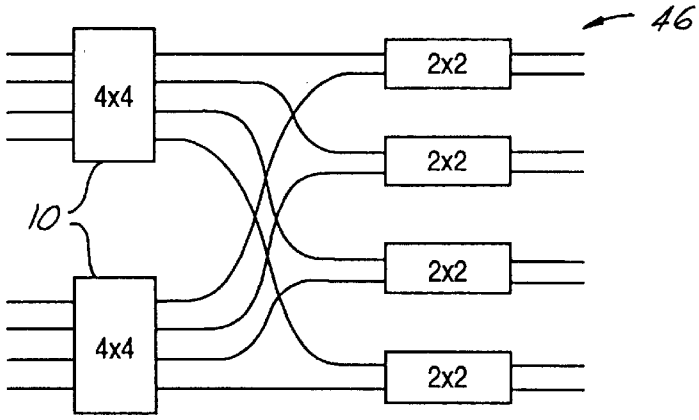
FIG. 9 is a graphical representation of the 4×4 power divider/combiner of the present invention used in an 8×8 power divider/combiner.
Figure 10:
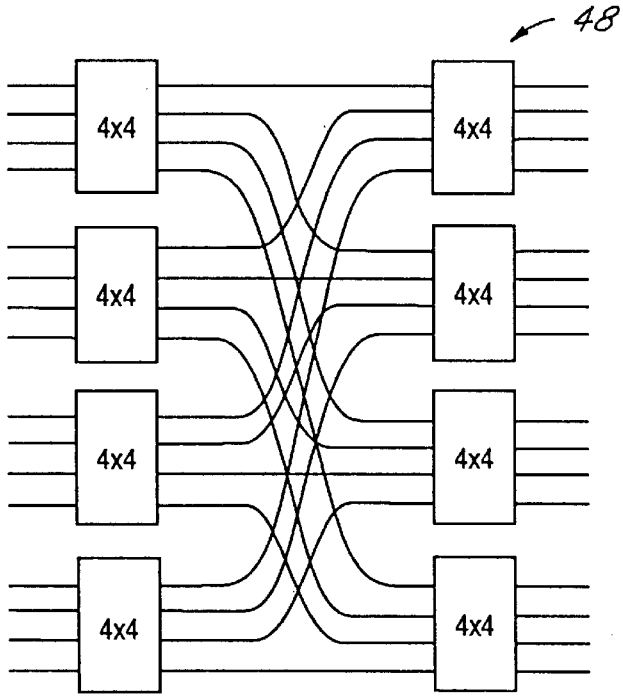
FIG. 10 is a graphical representation of the 4×4 power divider/combiner of the present invention used in a 16×16 power divider/combiner.

FIG. 9 is an example of the 4×4 power divider/combiner of the present invention used in conjunction with 2×2 power divider/combiners already known in the prior art to accomplish an 8×8 power divider combiner. FIG. 10 is an example of a 16×16 power divider/combiner using multiple 4×4 power divider/combiners of the present invention.

Figure 11:
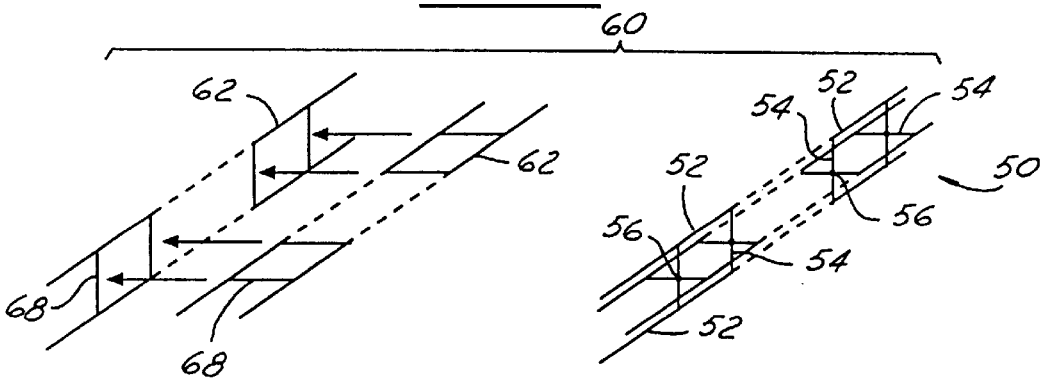
FIG. 11 is a graphical representation of another embodiment of a power divider/combiner of the present invention.

In another embodiment of the present invention, shown in FIG. 11, a compact 4×4 power divider/combiner 50 is shown, along with a method 60 of making the compact 4×4 power divider/combiner 50. The compact 4×4 power divider/combiner 50 has through transmission lines 52 having equal lengths of one-fourth the guide wavelength, $\lambda_g/4$. Branch transmission lines 54 are joined at a node 56 at their central points. Therefore, the branch transmission lines 54 also have equal lengths, $\lambda_g/8$.

The method 60 for making the compact power divider/combiner 50 includes merging two identical 0 dB branch-line couplers 62 forming junctions, or nodes 56 at the central point 68 of each branch transmission line 54. The result is a 4×4 power divider/combiner 50 having a bandwidth that may be increased by increasing the bandwidth of the 0 dB coupler 62. This is generally accomplished by increasing the number of branch transmission lines 54.

For a predetermined number of branch transmission lines 54 ,it is possible to design many different 4×4 power divider/combiners, derived from 0 dB couplers 62, having various frequency responses. The requirements for a specific application will dictate the performance required, therefore it is impossible to identify an optimum design.

Figure 12:
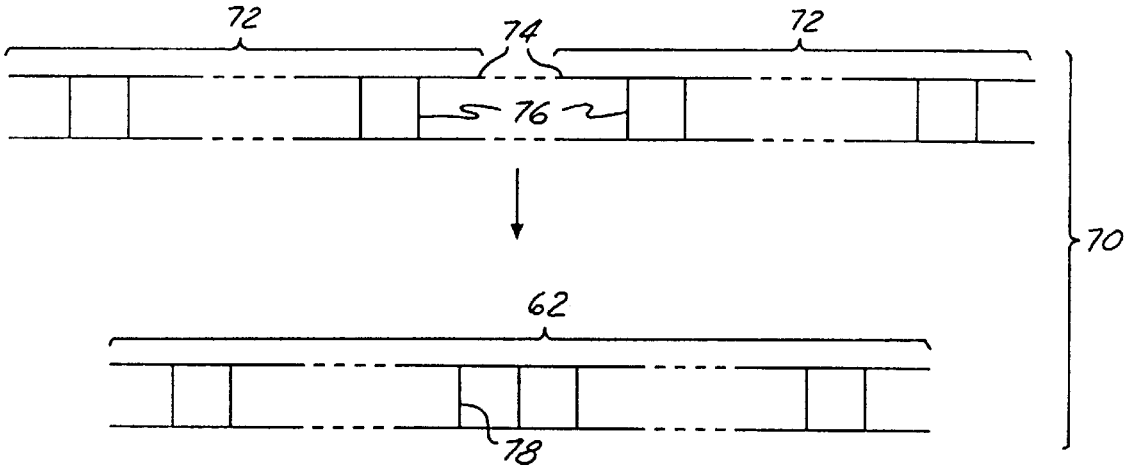
FIG. 12 is a graphical representation of the combination of two 3 dB couplers cascaded and combined to form a single 0 dB coupler.

An alternative to using two 0 dB periodic couplers 54 is the method 70 shown in FIG. 12 wherein the same 4×4 power divider/combiner 50 is accomplished by cascading two 3 dB couplers 72 to construct a 0 dB coupler 54, which can be combined with another 0 dB coupler by the method 60 described above, and shown in FIG. 11, to achieve a compact 4×4 power divider/combiner. Using the method 60 shown in FIG. 12 it is also possible to further reduce the power divider/combiner's weight by eliminating the lines 74 connecting the two 3 dB couplers 72 and combining the innermost branch lines 76 into a single line 78.

Figure 13:
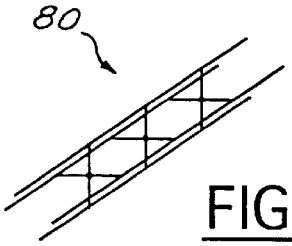
FIG. 13 is a three-branch 4×4 power divider/combiner of the present invention.
Figure 14:
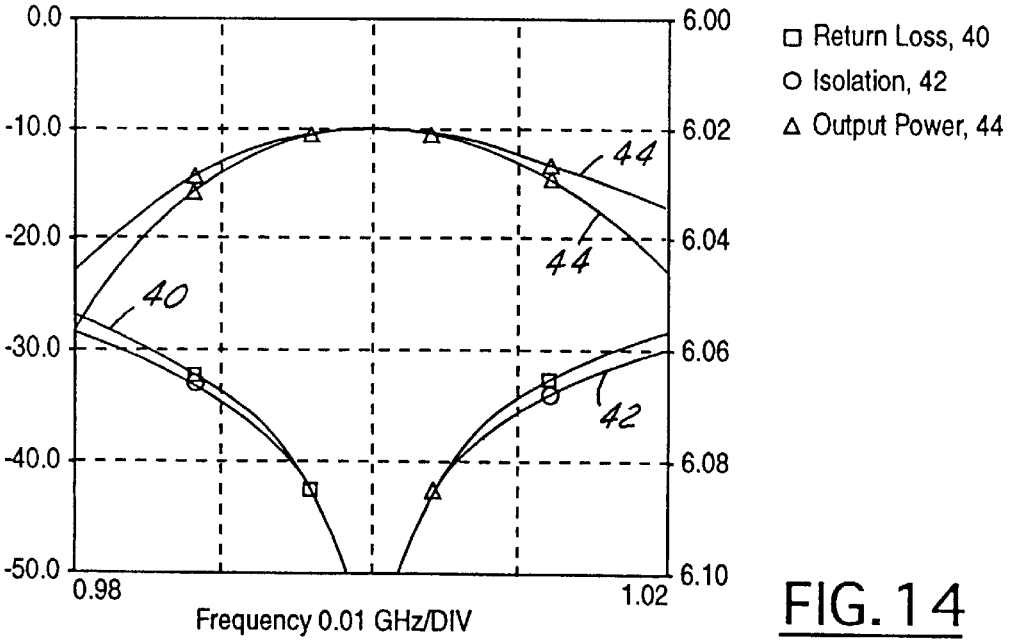
FIG. 14 is the frequency response of the power divider/combiner of FIG. 13.

Three examples are presented below to illustrate potential performance using the design methods 60 and 70 of the present invention. FIG. 13 is an example of a three-branch power divider/combiner 80 that was derived using the method 70 shown in FIG. 12. It should be noted that it is also possible to form the three-branch power divider/combiner 80 using two three-branch 0 dB couplers as well. Slight performance degradation is realized. However, the predicted differential phase error for both configurations is less than 1° over the 4% bandwidth shown in FIG. 14. FIG. 14 is the frequency response of the power divider/combiner of FIG. 13 showing the predicted frequency variation of the return loss 40, isolation 42 and output power 44 for the three-branch power divider/combiner 80.

Figure 15:
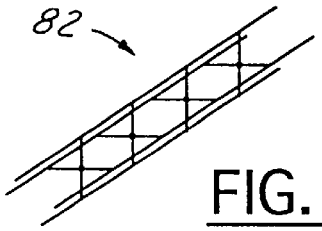
FIG. 15 is a four-branch 4×4 power divider/combiner of the present invention.
Figure 16:
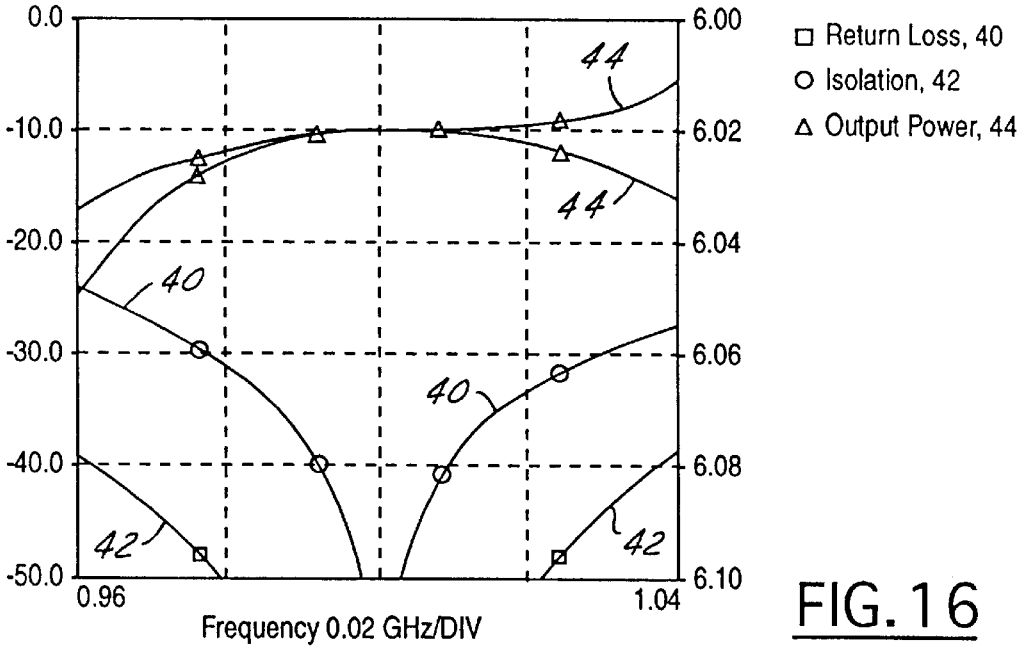
FIG. 16 is the frequency response of the power divider/combiner of FIG. 15.

FIG. 15 shows a four-branch power divider/combiner 82 derived directly from a four branch 0 dB periodic coupler using the method shown in FIG. 11. The predicted differential phase error is less than 2° over the 8% bandwidth shown in FIG. 16. FIG. 16 shows the predicted frequency variation of the return loss 40, isolation 42, and output power 44 for the four-branch power divider/combiner 82.

Figure 17:
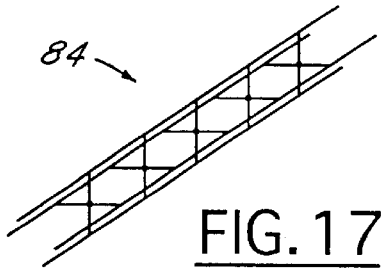
FIG. 17 is a five-branch 4×4 power divider/combiner of the present invention.
Figure 18:
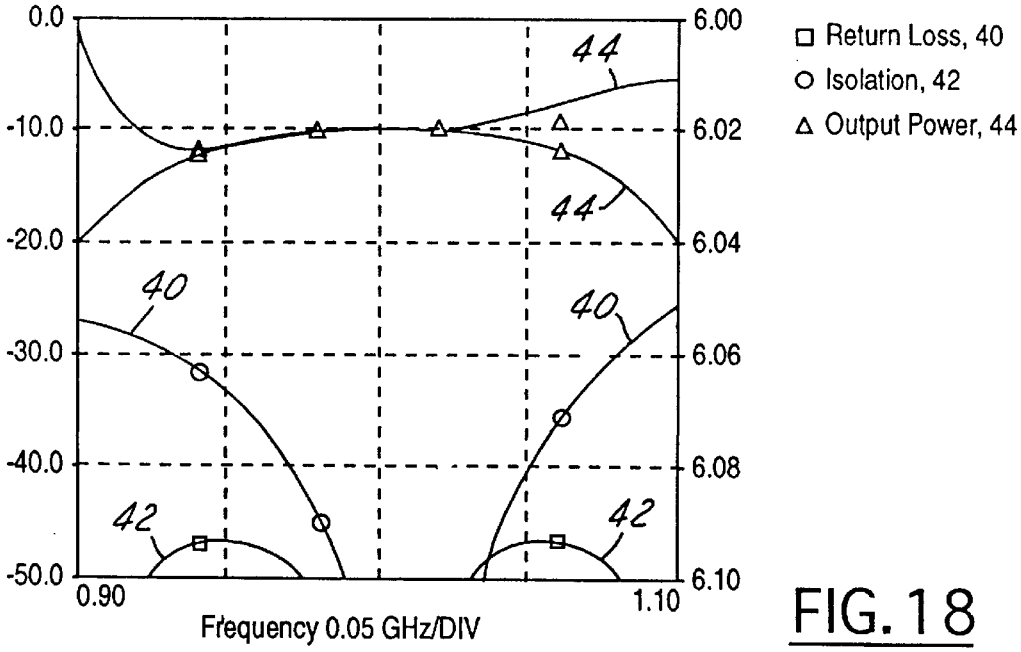
FIG. 18 is the frequency response of the power divider/combiner of FIG. 17.

FIG. 17 is a five-branch power divider/combiner 84 derived from a three-branch 3 dB maximally flat coupler in cascade to form a 0 dB coupler and then combined as shown in FIGS. 11 and 12. The predicted phase differential error is less than 6° over the 20% bandwidth shown in FIG. 18. FIG. 18 is a graph of the frequency response for the five-branch power divider/combiner showing the frequency variation of the return loss 40, isolation 42, and output power 44 for the five-branch power divider/combiner 84 .

While particular embodiments of the invention have been shown and described, numerous variations and alternate embodiments will occur to those skilled in the art. Accordingly, it is intended that the invention be limited only in terms of the appended claims.

What is claimed is:

1. A power divider/combiner for dividing received powers at each of four input ports, transmitting the divided powers to each of four output ports and combining the transmitted powers at each of said output ports, the power divider/combiner comprising:

a series of through transmission lines connecting each of said input ports to a corresponding output port, each of said series of through transmission lines comprising:

a primary through transmission line having a first end and a second end;

two secondary through transmission lines having first and second ends, said secondary transmission lines flanking and interconnecting with either end of said through transmission line whereby the interconnection of said second end of one of said secondary through transmission lines and said first end of said primary through transmission line defines a node and the interconnection of said second end of the other of said secondary through transmission lines and said second end of said primary through transmission line defines a node;

a series of branch transmission lines interconnecting said input ports at a first central node;

a series of secondary branch transmission lines interconnecting said first set of secondary through transmission lines at a second central node;

a series of branch transmission lines interconnecting said output ports at a third central node; and a series of secondary branch transmission lines interconnecting said second set of secondary through transmission lines at a fourth central node.

2. The power divider/combiner as claimed in claim 1 wherein said transmission lines are waveguides.

3. The power divider/combiner as claimed in claim 1 wherein said transmission lines are coaxial lines.

4. The power divider/combiner as claimed in claim 1 wherein said transmission lines are planar transmission lines.

5. The power divider/combiner as claimed in claim 1 wherein said primary through transmission lines are all the same length, said secondary through transmission lines are all the same length and different from said primary through transmission lines an d said branch and secondary branch transmission lines are all the same length and different from said primary and secondary through transmission lines.

6. The power divider/combiner as claimed in claim 5 wherein said power divider combiner is configured for operation with signals having a guide wavelength $\lambda_g$ and said primary through transmission lines have an electrical length $\lambda_g/2$, said secondary through transmission lines have an electrical length $\lambda_g/4$, and said branch and secondary branch transmission lines have an electrical length $\lambda_g/8$.

7. The power divider/combiner as claimed in claim 1 wherein said primary through transmission lines have a normalized characteristic impedance dependent upon a desired frequency bandwidth.

8. The power divider/combiner as claimed in claim 1 wherein said secondary through transmission lines and said secondary branch transmission lines have a normalized characteristic impedance equal to one-half, said branch transmission lines have a normalized characteristic impedance equal to one, and said primary through transmission lines have a normalized characteristic impedance dependent upon a desired frequency bandwidth.

9. The power divider/combiner as claimed in claim 1 wherein said power divider/combiner is used in combination with couplers to construct a flat $2^n \times 2^n$ combiners to divide powers to each of $2^n$ output ports, wherein n is an integer >1.

10. The power divider/combiner as claimed in claim 1 wherein said power divider/combiner is used in combination with a plurality of power divider/combiners to construct a flat $2^n \times 2^n$ combiner to divide powers at each of $2^n$ output ports, wherein n is an integer >1.

11. A power divider/combiner for dividing received powers at each of four input ports to each of four output ports, transmitting the divided powers to each of four output ports, and combining the transmitted powers at each of said output ports, said power divider/combiner comprising:

a series of through transmission lines all having equal lengths; and a plurality of branch transmission lines separating said through transmission lines at predetermined intervals, said branch transmission lines being interconnected at a central node.

12. The power divider/combiner as claimed in claim 11 wherein said transmission lines are waveguides.

13. The power divider/combiner as claimed in claim 11 wherein said transmission lines are coaxial lines.

14. The power divider/combiner as claimed in claim 11 wherein said transmission lines are planar transmission lines.

15. A method for making a power divider/combiner for dividing received powers at each of four input ports, transmitting the divided powers to each of four output ports and combining the transmitted powers at each of said output ports, the method comprising the steps of:

merging two 0 dB couplers, each of said 0 dB couplers having a predetermined number of branch transmission lines; and creating a plurality of junctions, each of said junctions at a central point of each of said branch transmission lines for both said 0 dB couplers, whereby a node is created at the point of intersection of said branch transmission lines of each of said 0 dB couplers;

wherein a compact 4×4 power divider/combiner is derived, said power divider/combiner having a predetermined number of branches equal to said predetermined number of branch transmission lines of said 0 dB couplers.

16. The method as claimed in claim 15 wherein said step of merging two 0 dB couplers further comprises the step of creating a 0 db coupler wherein two 3 dB couplers are cascaded and combined to form a single 0 dB coupler.

* * * * *